US006307453B1

(12) United States Patent
Wellner et al.

(10) Patent No.: US 6,307,453 B1
(45) Date of Patent: Oct. 23, 2001

(54) CIRCUIT BREAKER WITH INSTANTANEOUS TRIP PROVIDED BY MAIN CONDUCTOR ROUTED THROUGH MAGNETIC CIRCUIT OF ELECTRONIC TRIP MOTOR

(75) Inventors: Edward Louis Wellner, Colgate; Paul Jason Rollmann, Milwaukee; Peter Klaus Moldovan, Cascade; Mark Allan Juds, New Berlin, all of WI (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/506,871

(22) Filed: Feb. 15, 2000

(51) Int. Cl.[7] ..... H01H 75/10; H01H 77/06; H01H 81/03; H01H 83/00

(52) U.S. Cl. ..... 335/6; 335/18; 335/21; 335/38; 335/41; 335/172; 335/174

(58) Field of Search ..... 335/6, 21, 22, 335/23, 35, 36, 38, 41, 68, 77, 167, 170, 171, 172, 173, 174, 175, 18

(56) References Cited

U.S. PATENT DOCUMENTS

| | | |
|---|---|---|
| 4,812,799 | 3/1989 | Cobb, III et al. . |
| 5,224,006 | 6/1993 | MacKenzie et al. . |
| 5,757,602 | 5/1998 | Meili et al. . |
| 5,886,860 | 3/1999 | Chen et al. . |

*Primary Examiner*—Ramon M. Barrera
(74) *Attorney, Agent, or Firm*—Marvin L. Union

(57) ABSTRACT

The toggle mechanism of a circuit breaker is connected at one end to the pivoted contact arm and at the other end to a pivoted latch lever which is engaged to latch the toggle mechanism by a latch member pivoted for movement in a plane perpendicular to the plane of the toggle mechanism. The latch member serves as an armature for a trip motor energized by a trip circuit responsive to an arc fault and/or a ground fault to unlatch the toggle mechanism and trip the circuit breaker open. The latch member is also tripped by a helical bimetal responsive to persistent overcurrents and coupled to the latch member through an ambient compensator bimetal cantilevered from the latch member. A flexible shunt connected between the helical bimetal and contact arm passes through an extension of the magnetic circuit of the trip motor to generate a magnetic field of sufficient strength to trip the latch member instantaneously in response to a short circuit.

8 Claims, 9 Drawing Sheets

1

CIRCUIT BREAKER WITH INSTANTANEOUS TRIP PROVIDED BY MAIN CONDUCTOR ROUTED THROUGH MAGNETIC CIRCUIT OF ELECTRONIC TRIP MOTOR

RELATED APPLICATION

Commonly owned, concurrently filed application entitled "Circuit Breaker with Latch and Toggle Mechanism Operating in Perpendicular Planes" and identified by 09/504,421 U.S. Pat. No. 6,225,883.

BACKGROUND OF THE INVENTION

1. Field of the Invention

This invention relates to circuit breakers of the type having a trip motor energized by a trip circuit responsive to selected fault conditions producing overcurrents smaller in magnitude than short circuit currents. In particular, it relates to a circuit breaker that couples the magnetic flux generated by short circuit currents into the magnetic circuit of the trip motor to trip the circuit breaker open independently of energization of the trip motor coil by the trip circuit. Such an arrangement is particularly advantageous in providing an instantaneous trip function for subminiature circuit breakers, but can also be applied to larger circuit breakers.

2. Background Information

One use of subminiature circuit breakers is in aircraft electrical systems where they not only provide overcurrent protection but also serve as switches for turning equipment on and off. As such, they are subjected to heavy use and therefore must be capable of performing reliably over many operating cycles. They also must be small to accommodate the high density layout of circuit breaker panels which make circuit breakers for numerous circuits accessible to a user. Subminiature circuit breakers can be used in an environment where they are subject to vibration. The circuit breaker must trip consistently within tolerance yet not be tripped out by vibration or shock loading.

Typically, subminiature circuit breakers have only provided protection against persistent overcurrents implemented by a latch triggered by a bimetal responsive to $I^2R$ heating resulting from the overcurrent. Some aircraft systems have also provided ground fault protection, but through the use of additional devices, namely current transformers which in some cases are remotely located from the protective relay. There is a growing interest in providing additional protection, and most importantly arc fault protection. Currently available subminiature circuit breakers do not respond to arc faults which are typically high impedance faults and can be intermittent. Nevertheless, such arc faults can result in a fire. Finally, there is an interest in providing an instantaneous trip in response to very high overcurrents such as would be drawn by a short circuit.

While larger circuit breakers, even the "miniature" circuit breakers used in residential applications provide multiple protection functions, the currently available subminiature circuit breakers do not have such combined features. Again, the challenge is to provide alternative protection in a very small package which will operate reliably with heavy use over a prolonged period. A device which meets all the above criteria and can be automatically assembled is desirable.

SUMMARY OF THE INVENTION

The present invention is directed to a circuit breaker which can be miniaturized yet provides multiple protection functions. The circuit breaker has a main current conductor connected in series with the separable contacts and routed to induce magnetic flux in a trip motor which can be separately energized by an electronic trip circuit to actuate the latch member of a latchable operating mechanism to trip the separable contacts of the circuit breaker open. An overcurrent through the main current conductor of at least a predetermined magnitude, such as would be associated with a short circuit, actuates the latch member independently of energization of the trip motor coil to provide an instantaneous trip function for the circuit breaker.

More particularly, the circuit breaker comprises a housing, separable contacts mounted in the housing, a latchable operating mechanism including a latch member which when actuated unlatches to open the separable contacts, and a trip motor which actuates the latch member when energized. The circuit breaker further has an overcurrent assembly which includes a main current conductor connected in series with the separable contacts and routed to induce magnetic flux in the magnetic circuit of the trip motor to actuate the latch member in response to an overcurrent through the main current conductor of at least a predetermined magnitude. Finally, the circuit breaker includes a trip circuit energizing the trip motor in response to predetermined current conditions below the overcurrent of predetermined magnitude. Preferably, these predetermined current conditions can be for instance an arc fault.

The trip motor includes a coil and a magnetic circuit with the main current conductor being routed at least partially through this magnetic circuit so that magnetic flux generated by current in the main current conductor is coupled into the magnetic circuit thereby actuating the latch member. Preferably the main conductor is a flexible conductor and the trip motor further includes a bracket which extends the magnetic circuit of the trip motor at least partially around the flexible conductor. In the exemplary embodiment of the invention a frame which supports the latchable operating mechanism cooperates with the bracket to guide the flexible conductor through the magnetic circuit of the trip motor. The bracket is magnetically permeable to enhance the magnetic coupling of the flux generated in the flexible shunt into the magnetic circuit of the trip motor. Preferably, the latch member of the latchable operating mechanism forms the armature of the trip motor which is attracted by flux generated in the magnetic circuit either by energization of the trip coil or a current of at least the predetermined magnitude in the main current conductor.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

The invention will be described as applied to a subminiature circuit breaker. These circuit breakers can be used in aircraft ac systems which are typically 400 Hz but can also be used in dc systems. It will also become evident that the invention is applicable to other circuit breakers including those used in ac systems operating at other frequencies, and to larger circuit breakers.

Figure 1:
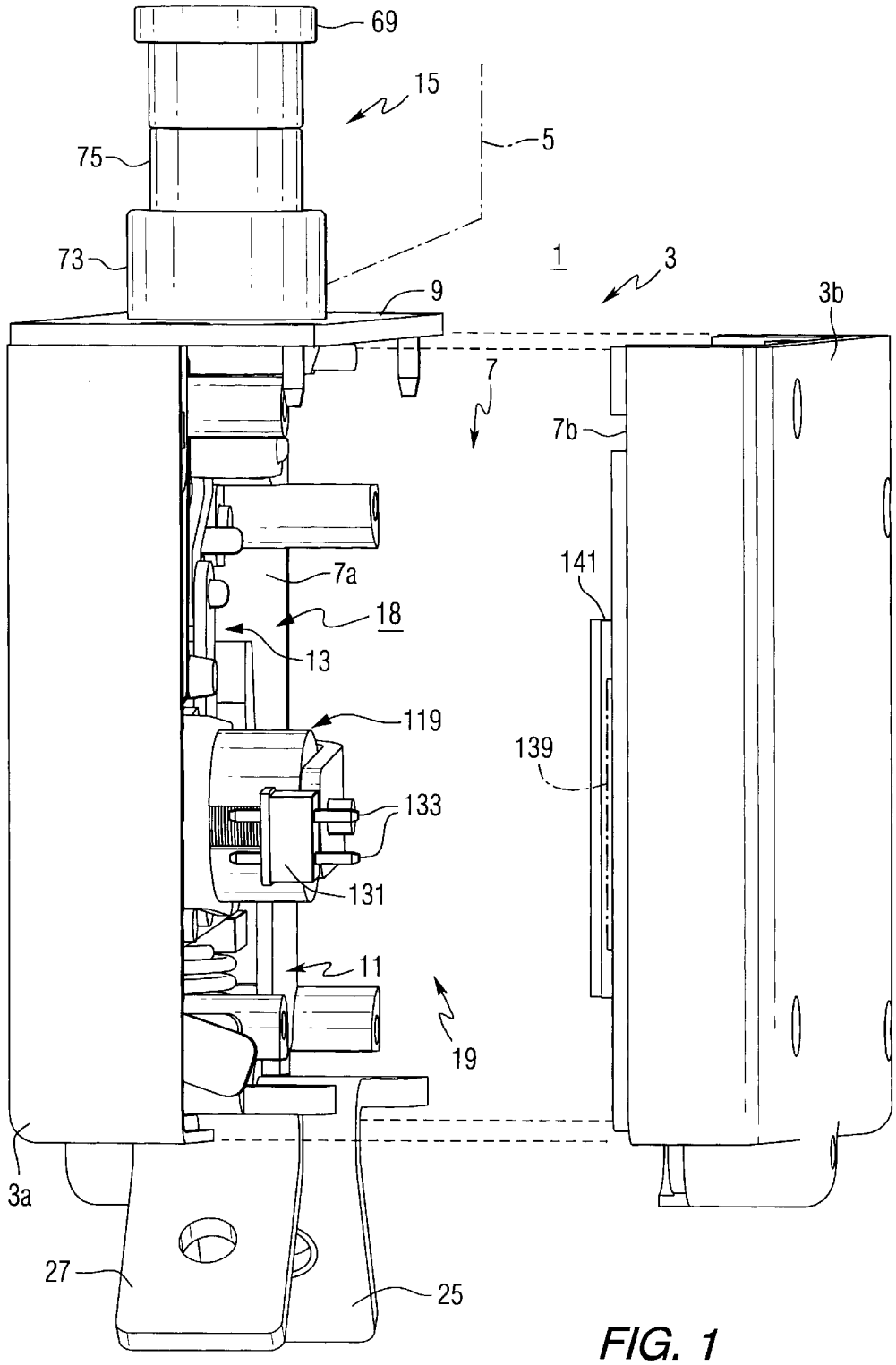
FIG. 1 is an isometric end view shown with the two molded sections of the housing separated.

Referring to FIG. 1, the circuit breaker 1 has a housing 3 formed by first and second sections 3*a* and 3*b* molded of an insulative resin which are joined along a mating plane 5 to form an enclosure 7 from confronting cavities 7*a* and 7*b*. The housing 3 of the exemplary circuit breaker has a metallic top wall 9 although alternatively this top wall can be part of the molded sections 3*a* and 3*b*.

Figure 2:
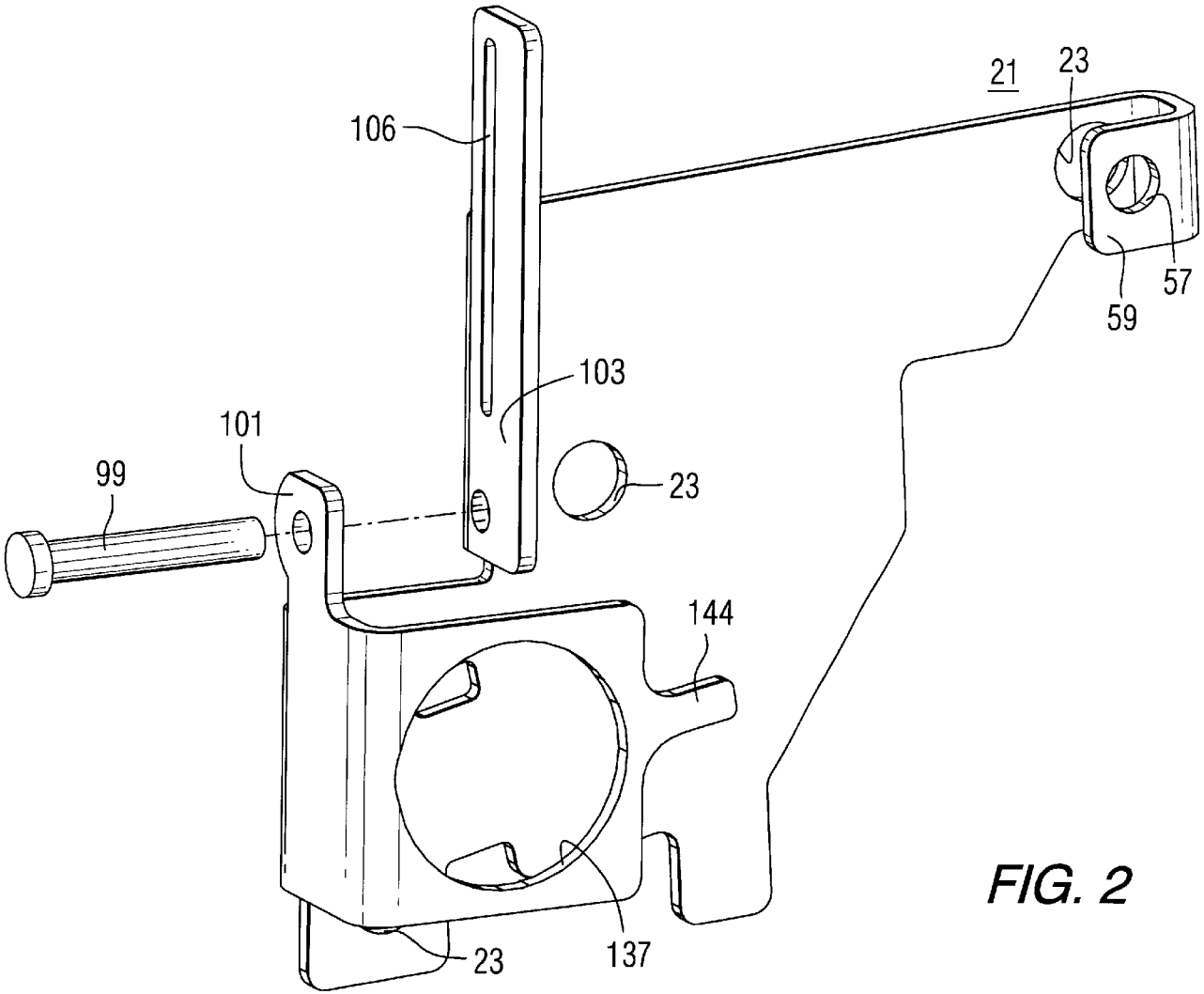
FIG. 2 is an isometric view of the circuit breaker support frame.

The functional components of the circuit breaker 1 include a separable contact assembly 11, a toggle mechanism 13, a handle assembly 15, a latch assembly 17, and an overcurrent assembly 19. The toggle mechanism 13 and latch assembly 17 together form a latchable operating mechanism 18. Turning momentarily to FIG. 2, a sheet metal frame 21, which as will be seen supports many of these functional components, is mounted in the cavity 7*a* in the molded section 3*a* by mounting holes 23 which engage molded pins in the housing section 3*a* as will be seen. The circuit breaker 1 also includes a line terminal 25 and load terminal 27 supported in the bottom of the molded housing and having cantilevered sections extending outside of the housing for connection to line and load conductors, respectively (not shown).

Figure 5:
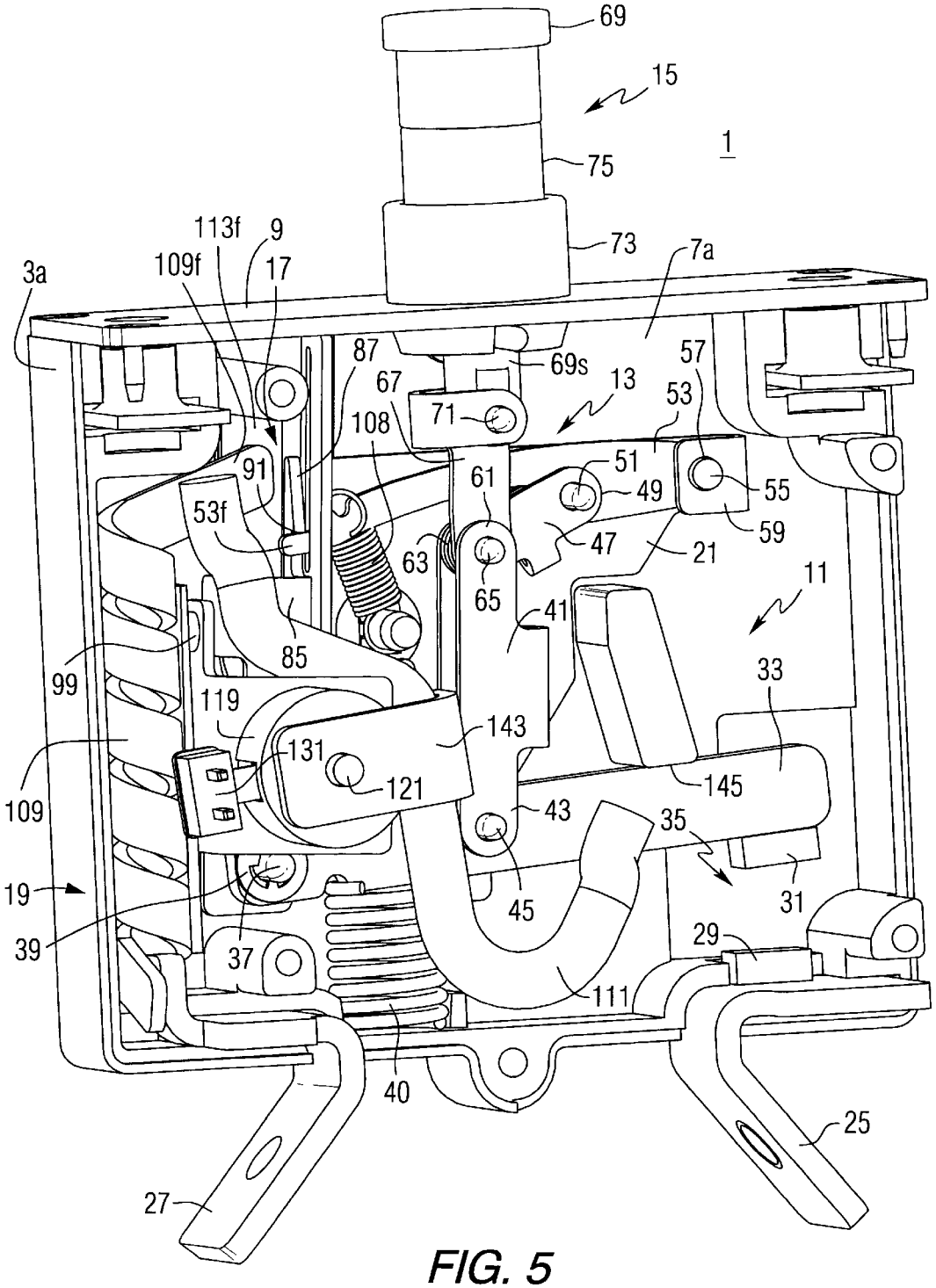
FIG. 5 is a front elevation view of the circuit breaker with one-half of the cover removed and showing the circuit breaker in the off condition.
Figure 6:
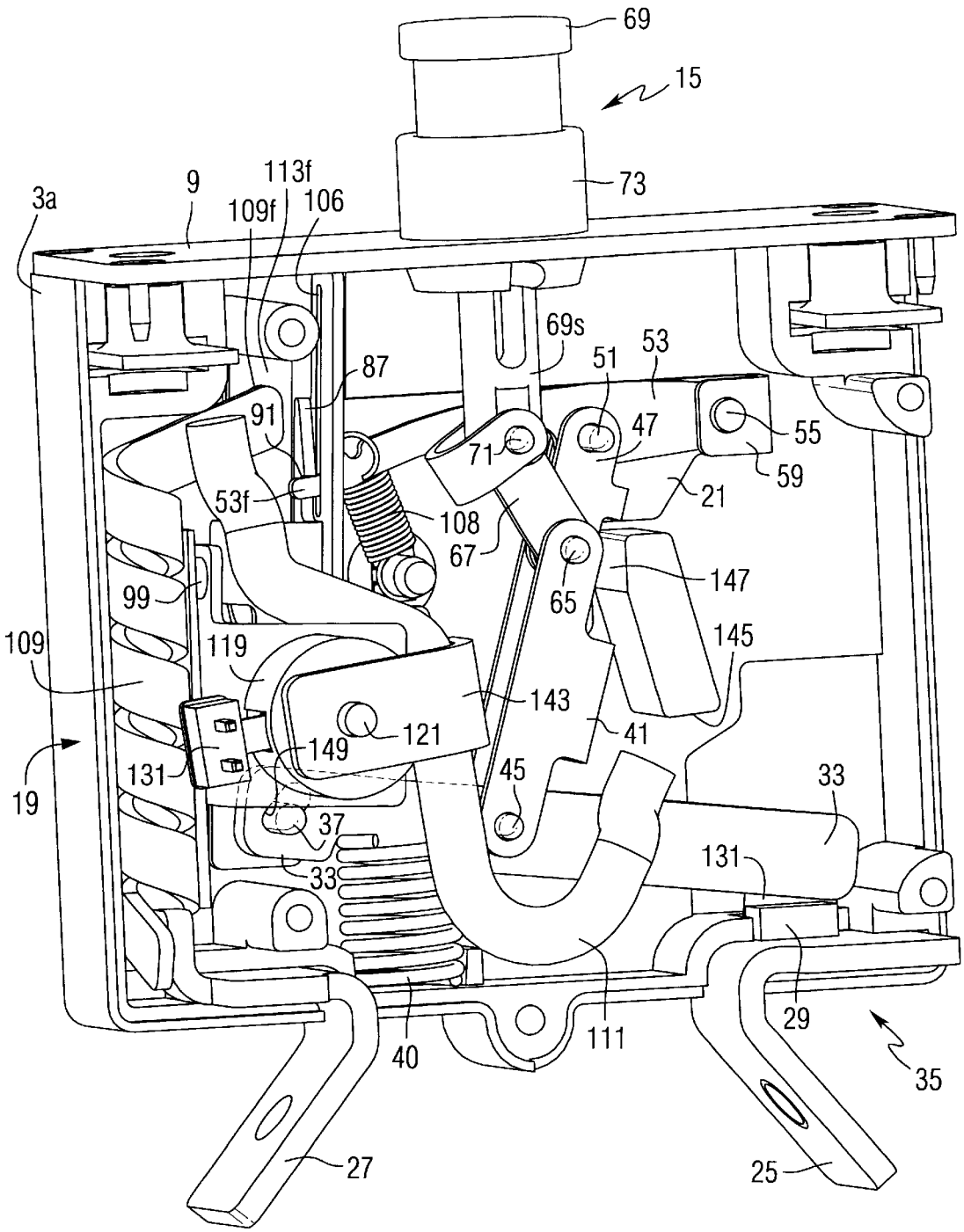
FIG. 6 is a view similar to FIG. 5 but showing the circuit breaker in the on condition.
Figure 7:
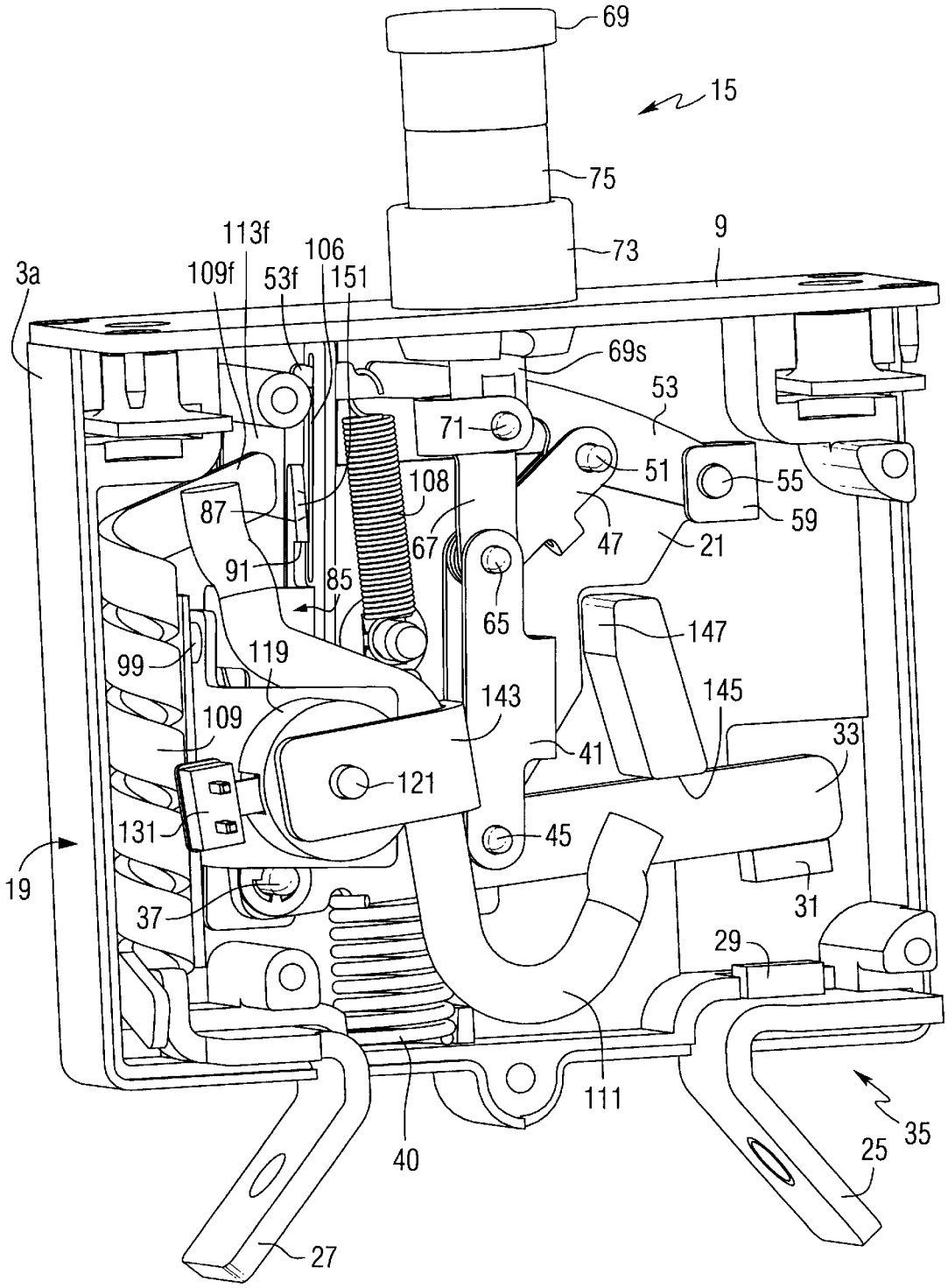
FIG. 7 is a view similar to FIG. 5 but showing the circuit breaker in the tripped condition.
Figure 9:
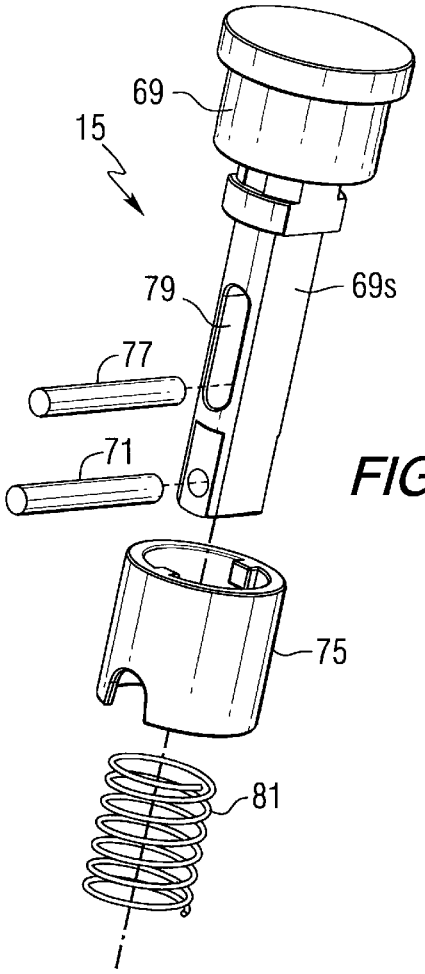
FIG. 9 is an exploded isometric view of parts of the handle assembly.

As best observed in FIGS. 5–7, the separable contact assembly 11 includes a fixed contact 29 fixed to the line terminal 25 and a moveable contact 31 carried by a contact arm 33. The fixed contact 29 and moveable contact 31 together form separable contacts 35. The contact arm 33 is pivotally mounted on a molded pin 37 which extends through one of the mounting holes 23 in the lower portion of the frame 21. A nut 39 retains the contact arm on the molded pin 37. A helical compression spring 40 forms a main spring which biases the contact arm counterclockwise as viewed in FIGS. 5–7 to open the separable contacts 35.

The contact arm 33 is pivoted between open and closed positions of the separable contacts 35 by the toggle mechanism 13. This toggle mechanism 13 includes a bifurcated first toggle link 41 pivotally connected at a first or lower end 43 to the contact arm 33 by a pin 45. A bifurcated second toggle link 47 is pivotally connected at a first end 49 by a pin 51 to a latch lever 53 which in turn is pivotally mounted by a molded pin 55 which extends through one of the mounting holes 23 in the frame 21 and into a hole 57 in a flange 59 on the frame 21. Second ends 61 and 63 of the first toggle link 41 and second toggle link 47, respectively, are pivotally connected by a knee pin 65. The toggle mechanism 13 further includes a drive link 67 which couples the toggle mechanism 13 to the handle assembly 15.

Figure 8:
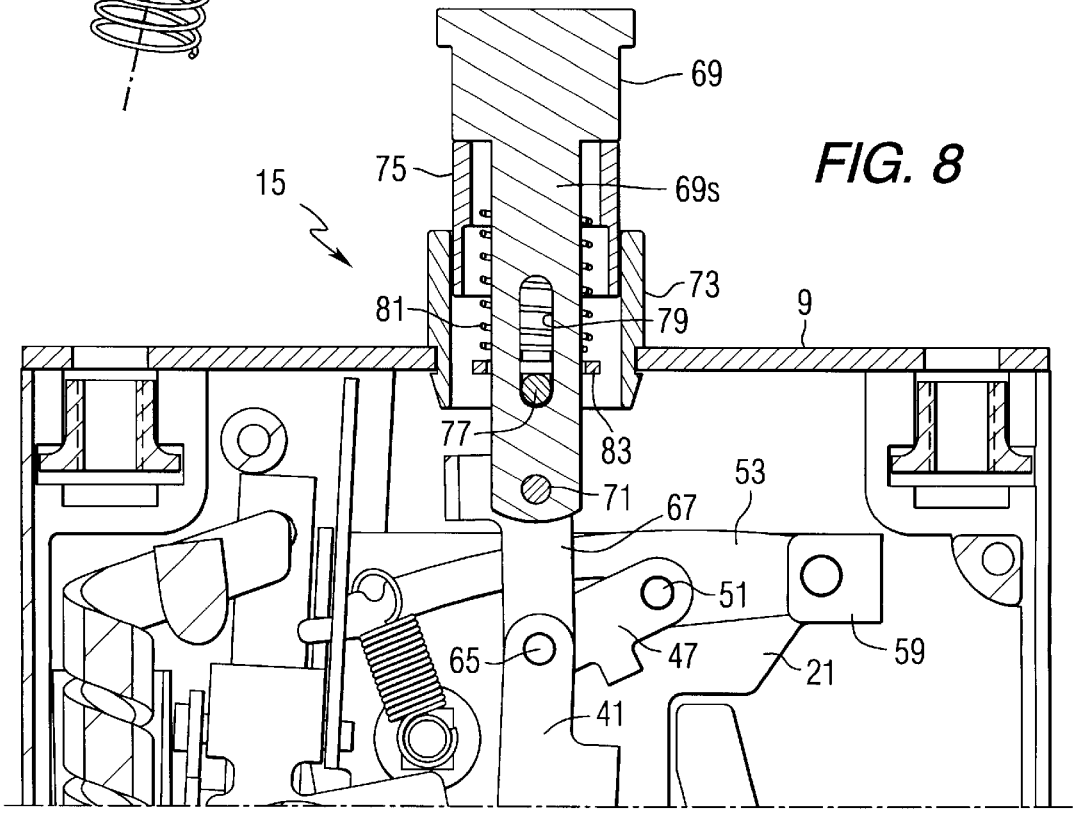
FIG. 8 is a fractional longitudinal section through the circuit breaker illustrating the handle assembly.

As can be seen from FIG. 8, the handle assembly 15 includes a handle member 69 having a stem 69*s* which is pivotally connected to the drive link 67 of the toggle mechanism 13 by a pin 71. The handle member 69 is supported for reciprocal linear movement by a bezel 73 seated in the end in the top wall 9 and an indicator sleeve 75. The handle member 69 is captured by a handle retention pin 77 extending transversely through the bezel 73 and a slot 79 in the handle stem 69*s*. A helical compression handle spring 81 on the handle stem 69*s* bears against a washer 83 which seats on the handle retention pin 77.

The latch assembly 17 includes in addition to the latch lever 53, a latch member 85. As can be observed in FIG. 8, the latch member 85 has a finger 87 terminating in a hook 89 which forms a latch surface 91. The latch member 85 has a flat armature section 93 with an upward extension 95 from which the latch finger 87 extends at right angles. A flange 97 also extends at right angles to the upward extension parallel to the contact finger 87. A latch pin 99 extends through the flange 97 and latch finger 87 to pivotally mount the latch member between first flange 101 and a second confronting flange 103 on the frame 21 (see FIG. 2). As can be seen from FIG. 3, the toggle links 41 and 47 pivot in a first plane 105 while the latch member 85 pivots in a second plane 107 which is substantially perpendicular to the first plane 105. As will be noticed, the contact arm 33, the latch lever 53 and the handle member 69 also move in the first plane. Additionally, it will be noted that the first plane 105 is substantially parallel to the mating plane 5 of the molded sections 3*a* and 3*b* of the housing.

Figure 3:
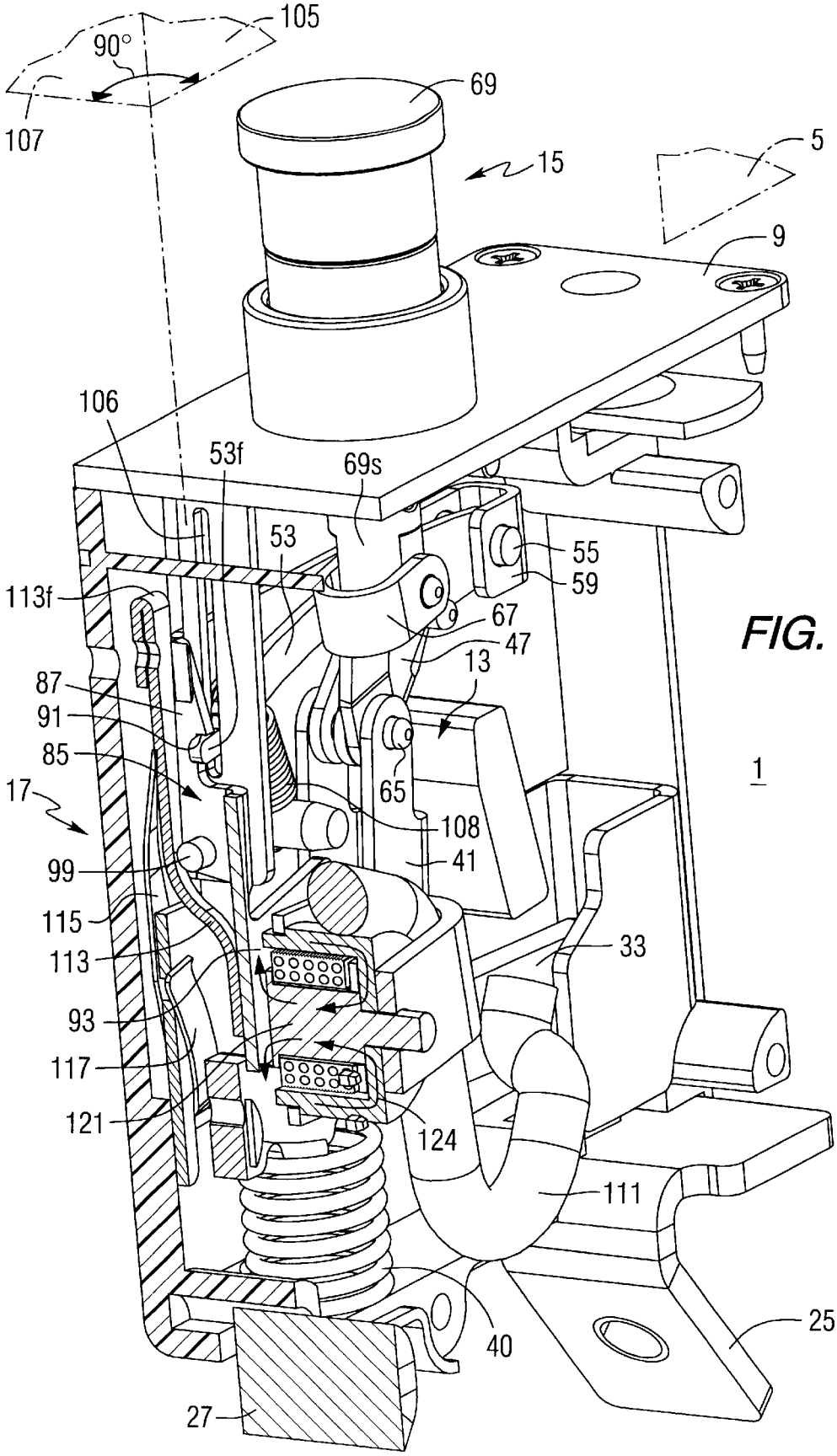
FIG. 3 is an isometric view from the front of the assembled latchable operating mechanism which forms part of the circuit breaker.

The latch surface 91 on the latch member 85 engages the free end 53*f* on the latch lever 53 which is guided in a slot 106 in the flange 103 on the frame 21 (see FIGS. 2 and 3). A latch lever spring 108 biases the latch lever 53 toward the latched position at the lower end of the slot 106.

The overcurrent assembly 19 includes a helical bimetal 109 which is fixed at one end to the load terminal 27. The free end 109*f* of the helical bimetal is connected by a main conductor in the form of a flexible shunt 111 to the contact arm 33. Thus, the load current which passes through the separable contacts 35 also passes through the helical bimetal 109. This causes $I^2R$ heating of the helical bimetal 109 resulting in unwinding of the free end 109*f*.

Figure 4:
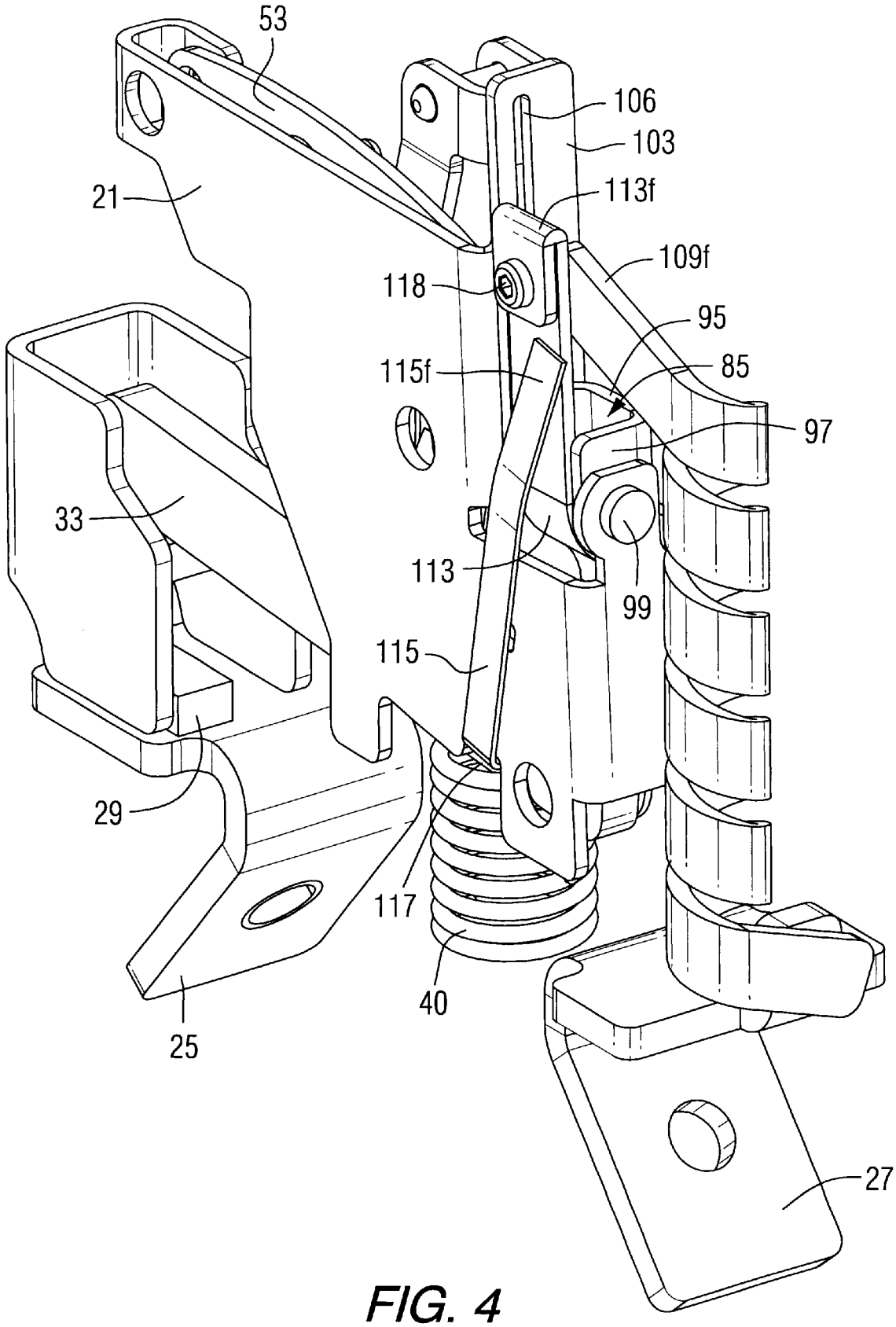
FIG. 4 is an isometric view from the rear of the assembly of FIG. 3.
Figure 10:
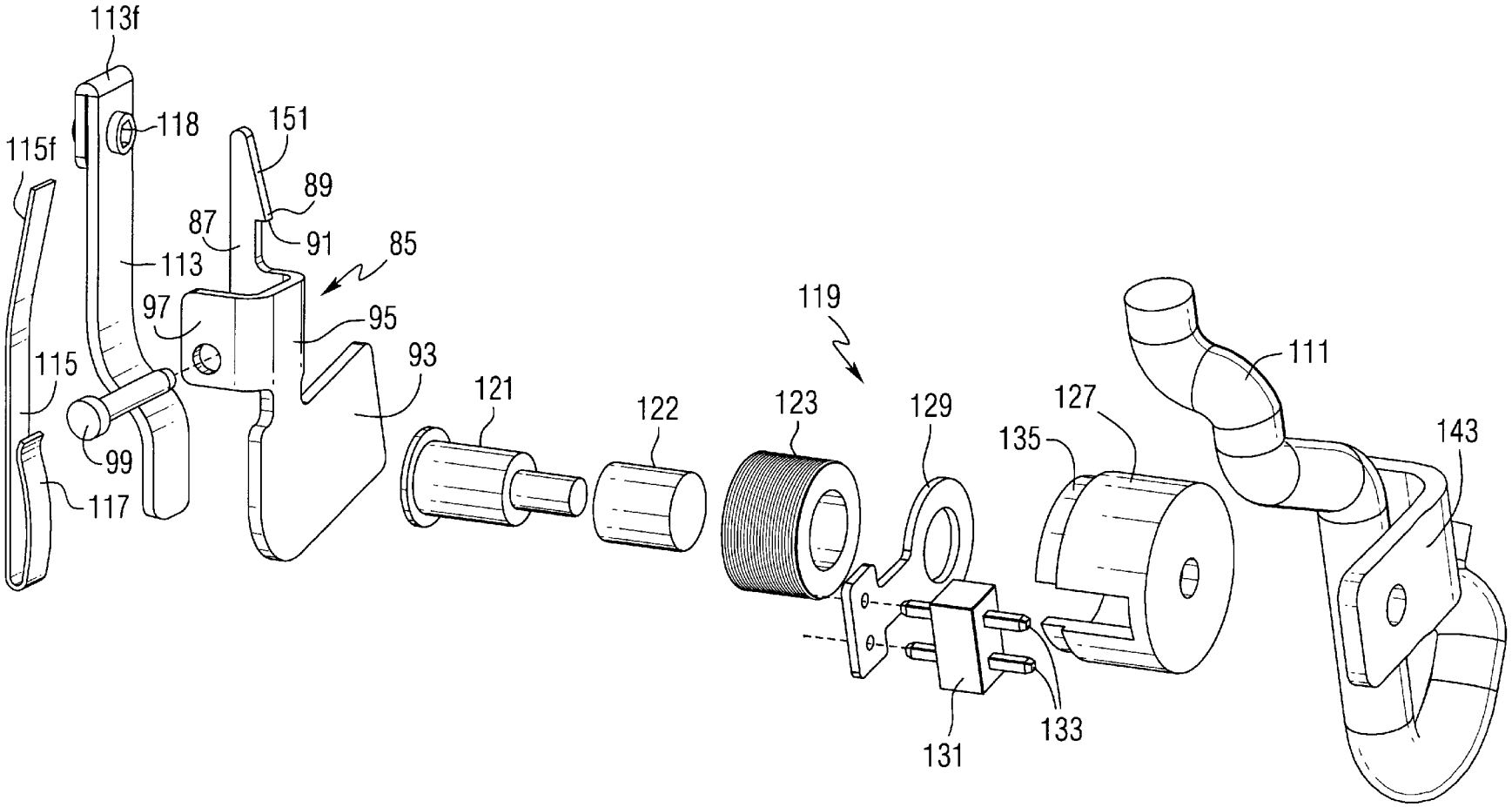
FIG. 10 is an exploded isometric view of the trip motor and latch which form part of the circuit breaker.

The overcurrent assembly 19 also includes a cantilevered ambient compensator bimetal 113. One end of this ambient compensator bimetal is fixed to the latch member at the armature section 93 such as by spot welding. This cantilevered ambient compensator bimetal 113 has an offset around the latch pin 99 (see FIG. 3) and extends upward to terminate in a free end 113*f* which is adjacent to the free end 109*f* of the helical bimetal 109 (see FIG. 4). A flat latch spring 115 is bent to form a clamp 117 (see FIG. 10) at the lower end which secures the flat latch spring to the frame 21 as shown in FIGS. 3 and 4. The free end 115*f* of this latch spring has a set which causes it to bear against the bimetal to bias the latch member 85 with the latch finger 87 forward. Under normal operating conditions there is a small gap between the free end 109 of the helical bimetal and the free end 115*f* of the ambient compensator bimetal.

The thermal trip can be calibrated by a calibration screw 118 which is threaded in the free end of one of the bimetals 109, 113 and projects towards the other. In the exemplary embodiment of the invention, this calibration screw 118 is seated in the free end 113*f* of the ambient compensator bimetal 113 as best seen in FIG. 4.

The overcurrent assembly 19 further includes a trip motor or solenoid 119. As shown in the exploded view of FIG. 10, this trip motor 119 includes a magnetically permeable motor core 121 which fits inside a coil sleeve 122 within the coil 123. This subassembly is housed in a magnetically permeable motor cup 127 which together with magnetically permeable core 121 form a magnetic circuit represented by the arrows 124 in FIG. 3. A pin holder 129 projects laterally outward through a slot in the motor cup and supports a connector 131 having pins 133 for the coil 121. The coil cup has a shoulder 135 which seats in an opening 137 in the frame 21 (see FIG. 2) with the motor core 121 facing the armature section 93 of the latch member 85. The trip motor 119 is energized through the electrical pins 133 by an electronic trip circuit 139 provided on a printed circuit board 141 shown in FIG. 1. This trip circuit 139 provides for instance arc fault protection. When the coil 123 is energized, the armature 93 of the latch member 85 is attracted toward the core 121 thereby rotating the contact finger 87 rearward to an unlatch position.

In order to provide an instantaneous trip, the overcurrent assembly 19 includes an arrangement for routing the main conductor formed by the flexible shunt 111 through the magnetic circuit 124 of trip motor 119 as shown in FIGS. 3, 5–7 and 10. For this purpose, the magnetic circuit is extended by a magnetically permeable bracket or pole piece 143 which at least partially surrounds the flexible shunt 111, so that magnetic flux generated by the current in the flexible shunt 111 flows through the bracket 143, the core 121 and magnetic cup 135, and the armature 93 of the latch member 85. Under short circuit conditions, the very high current circulating through the flexible shunt 111 generates a magnetic field which is coupled into the magnetic circuit 124 of the trip motor and attracts the latch member 85 to move the latch finger 87 to the unlatched position. The bracket 143 cooperates with a support finger 144 on the metal frame 21 (see FIG. 2) to secure the flexible shunt in place. The magnetic coupling is such that very high currents of at least a predetermined magnitude, such as those associated with short circuits, are sufficient to actuate the latch member 85 without energization of the coil 123 by the trip circuit 139.

The circuit breaker 1 operates in the following manner. In the off position shown in FIG. 5, the handle member 69 is up with the indicator sleeve 75 visible to indicate the off condition. The latch lever 53 is latched by engagement of its free end 53*a* by the latch surface 91 on the latch member 85. The knee pin 65 of the toggle mechanism 13 is to the left of an imaginary line between the pins 45 and 51. The main spring 40 has rotated the contact arm 33 counterclockwise against the molded stop 145 so that the separable contacts 35 are open. This is the toggle open position of the toggle mechanism 13.

The circuit breaker is turned on by depressing the handle member 69 which moves linearly downward to the position shown in FIG. 6. The drive link 67 pushes the knee pin 65 downward which results in clockwise rotation of the contact arm against the main spring 40 through the first toggle link 41. As the upper end of the second toggle link is held stationary by seating of the latch lever 53 against the bottom of the slot 106, the knee pin 65 translates counterclockwise until it passes through an imaginary line between the pins 45 and 51 at which point the main spring pressing up on the link 41 drives the knee pin 65 further counterclockwise until the toggle seats against the molded stop 147 in the toggle closed position shown in FIG. 6. This latter motion occurs through clockwise rotation of the contact arm 33 about the closed contacts 35 through the slotted aperture 149 by which the contact arm is pivotally mounted on the pin 37. With the contacts closed in this manner the main spring 40 provides contact pressure on the separable contacts 35 and accommodates for wear.

The circuit breaker 1 may be manually opened from the on position shown in FIG. 6 to the off position shown in FIG. 5 by raising the handle member 69. This translates the knee pin 65 counterclockwise through the drive link 67. Initially, a downward force is applied to the contact arm through the first toggle link 41, but when the knee pin passes through the center line between the pins 45 and 51, the toggle linkage breaks and the main spring 40 rotates the contact arm 33 counterclockwise until it seats against the molded stop 145 with the separable contacts 35 open. As the knee pin 65 translates clockwise the handle 69 rises to the off position shown in FIG. 5.

The circuit breaker 1 can be tripped to the open condition shown in FIG. 7 under several conditions. If a persistent overcurrent occurs, the free end 109*f* of the helical bimetal 109 rotates counterclockwise as viewed in FIG. 4 to engage the free end 113*f* of the ambient compensation bimetal and pushes it in the same direction to rotate the latch member 85 counterclockwise about the latch pin 99. This disengages the latch surface 91 to release the latch lever 53 which is driven clockwise about the molded pin 55 by the main spring which rotates the contact arm 33 counterclockwise to open the separable contacts 35 and through the toggle links 41 and 47. As this occurs, the handle spring 81 pulls the knee pin 65 through the center line between the pins 45 and 51.

The circuit breaker 1 is reset from the trip condition shown in FIG. 7 by the latch lever spring 108 which pulls the latch lever 53 counterclockwise with the help of the latch lever spring 108 until the free end 53f of the latch lever engages the cam surface 151 on the latch finger 87 to rotate the latch finger rearward. When the free end 53*f* of the latch lever 53 passes under the latch surface 91, the latch spring 115 rotates the latch member 85 back clockwise to latch the latch lever 53. Ambient temperature conditions cause the free end 109*f* of the helical bimetal and the free end 113*f* of the ambient compensator bimetal to move in the same direction and thereby maintain the appropriate gap between the two bimetal free ends to eliminate the effects of changes in ambient temperature.

For protection against arc faults, the electronic trip circuit 139 monitors the current for characteristics of such faults and energizes the coil 123 of the trip motor 119. The magnetic flux generated by the energization of the coil 123 attracts the armature section 93 of the latch member toward the motor core 121 to slide the latch surface 91 off of the tip 53*f* of the latch lever 53 thereby tripping the circuit breaker 1 open in the manner discussed above for a thermal trip.

In the event of a very high overcurrent of at least a predetermined magnitude such as could be associated with a short circuit, the flexible shunt 111 generates a magnetic field which is coupled into the bracket 143, the coil cup 135 and the trip motor core 121 to again attract the armature section 93 and rotate the latch member 85 to release the latch lever 53 and trip the circuit breaker in the manner described above.

The circuit breaker 1 is a simple reliable mechanism which selectively provides multiple protection functions as well as serving as an off/on switch. As the toggle mechanism 13 and the latch 85 operate in perpendicular planes, the circuit breaker 1 has enhanced immunity to vibrations which typically are confined to a single plane. This arrangement also lends itself to automated assembly. The molded section 3*a* of the housing 3 is placed on a flat surface and the parts are all inserted from above. The frame 21, the toggle mechanism 13, the handle assembly 15, the latch assembly 17 and the bimetals 109,113 all fit into the cavity 7*a* in this section 3*a* of the housing 3. The trip motor 119 is seated in the opening 137 in the frame 21 and the printed circuit board 141 is connected to the electrical pins 133. The trip motor 119 and printed circuit board 141 which then project above the molded section 3*a,* extend into the enclosure portion 7*a* in the second molded section 3*b* which is placed over the section 3*a* and secured thereto by rivets (not shown).

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A circuit breaker comprising:

a housing;

separable contacts mounted in said housing;

a latchable operating mechanism including a latch member which when actuated unlatches to open said separable contacts; and an overcurrent assembly comprising:

a trip motor which actuates said latch member when energized and having a magnetic circuit;

a main current conductor connected in series with said separable contacts and routed to induce a magnetic flux in said magnetic circuit of said trip motor which actuates said latch member in response to an overcurrent through said main current conductor of at least a predetermined magnitude; and a trip circuit energizing said trip motor in response to predetermined current conditions below said overcurrent of predetermined magnitude.

2. The circuit breaker of claim 1 wherein said trip circuit energizes said trip motor in response to predetermined conditions such as an arc fault.

3. The circuit breaker of claim 1 wherein said main conductor is routed at least partially through said magnetic circuit to couple magnetic flux generated by current in said main conductor into said magnetic circuit.

4. The circuit breaker of claim 3 wherein said main conductor is a flexible conductor and said trip motor further includes a magnetically permeable bracket which at least partially surrounds said flexible conductor and extends said magnetic circuit around said flexible conductor.

5. The circuit breaker of claim 3 wherein said trip motor includes a magnetically permeable bracket forming a pole piece concentrating magnetic flux generated by current in said main conductor into said magnetic circuit.

6. The circuit breaker of claim 5 wherein said housing includes a frame supporting said latchable operating mechanism and which cooperates with said bracket to guide said main conductor at least partially through said magnetic circuit.

7. The circuit breaker of claim 6 wherein said latch member is magnetically permeable and forms an armature of said trip motor which is attracted by flux in said magnetic circuit to unlatch the latchable operating mechanism and open said separable contacts.

8. The circuit breaker of claim 3 wherein said trip motor further includes a coil, and said latch member is magnetically permeable and forms an armature of said trip motor which is attracted by magnetic flux in said magnetic circuit generated either by energization of said trip coil by said trip circuit or by magnetic flux generated by said current of at least said predetermined magnitude in said main conductor.

* * * * *